US008499694B2

(12) United States Patent
Bittle et al.

(10) Patent No.: US 8,499,694 B2
(45) **Date of Patent: *Aug. 6, 2013**

(54) TWO-FIN STACKABLE FLECHETTE HAVING TWO-PIECE CONSTRUCTION

(75) Inventors: David A. Bittle, Somerville, AL (US); Robert V. Weber, Hunstville, AL (US); Julian L. Cothran, Arab, AL (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/249,719

(22) Filed: Sep. 30, 2011

(65) Prior Publication Data

US 2012/0279413 A1 Nov. 8, 2012

Related U.S. Application Data

(63) Continuation-in-part of application No. 13/101,018, filed on May 4, 2011, now Pat. No. 8,375,860.

(51) Int. Cl.
*F42B 10/04* (2006.01)
*F42B 12/02* (2006.01)

(52) U.S. Cl.
USPC ..... 102/501; 102/517; 102/703; 244/3.24

(58) Field of Classification Search
USPC ..... 102/491, 501, 517, 519, 703; 244/3.1, 244/3.24
See application file for complete search history.

(56) References Cited

U.S. PATENT DOCUMENTS

| | | | | |
|---|---|---|---|---|
| 582,982 | A * | 5/1897 | Cope | 244/3.23 |
| 2,939,395 | A | 6/1960 | Barr | |
| 2,979,285 | A | 4/1961 | Planitizer | |
| 3,033,116 | A * | 5/1962 | Critcher et al. | 102/521 |
| 3,148,472 | A * | 9/1964 | Hegge et al. | 42/106 |
| 3,412,681 | A * | 11/1968 | Schirneker | 102/438 |
| 3,545,383 | A | 12/1970 | Lucy | |
| 3,851,590 | A | 12/1974 | LaCosta | |
| 3,880,083 | A | 4/1975 | Wasserman et al. | |
| 3,915,092 | A * | 10/1975 | Monson et al. | 102/399 |

(Continued)

FOREIGN PATENT DOCUMENTS

| | | | |
|---|---|---|---|
| DE | 3838737 | A1 * | 5/1990 |
| DE | 3940969 | A1 * | 6/1991 |

OTHER PUBLICATIONS

Howstuff Works, "Basics, Alternative Shotgun Shells", copyright 2005, (picture of flechette shell) http://science.howstuffworks.com/shotgun11.htm.

(Continued)

*Primary Examiner* — Bret Hayes
(74) *Attorney, Agent, or Firm* — Michael K. Gray

(57) ABSTRACT

A flechette has a forward body (20) containing its center of gravity which is connected to a tail section (24). The tail section has a pair of fins (24A, 24B) each having a preselected longitudinal angle and radial angle. When the two fins are viewed from the aft of the flechette, the pair of fins demonstrate a S-shaped orientation. The size, shape and orientation of the pair of fins provide aerodynamic stability to the flechette while allowing the flechette to be stacked with like-shaped flechettes. The two-piece assembly of the flechette easily accommodates the use of different density materials for the respective pieces.

15 Claims, 6 Drawing Sheets

U.S. PATENT DOCUMENTS

| | | | | |
|---|---|---|---|---|
| 3,941,059 | A | 3/1976 | Cobb | |
| 3,977,324 | A * | 8/1976 | Stevenson et al. | 102/442 |
| 4,043,798 | A * | 8/1977 | Nashiwa et al. | 420/84 |
| 4,448,106 | A * | 5/1984 | Knapp | 89/1.11 |
| 4,471,358 | A * | 9/1984 | Glasser | 342/12 |
| 4,546,940 | A * | 10/1985 | Andersson et al. | 244/3.29 |
| 4,597,333 | A | 7/1986 | Becker et al. | |
| 4,627,357 | A | 12/1986 | Gobis | |
| 4,638,738 | A | 1/1987 | Bisping et al. | |
| 5,223,667 | A | 6/1993 | Anderson | |
| 5,473,989 | A | 12/1995 | Buc | |
| 5,476,045 | A * | 12/1995 | Chung et al. | 102/529 |
| 5,796,031 | A | 8/1998 | Sigler | |
| 6,779,462 | B2 * | 8/2004 | Lloyd | 102/475 |
| 7,007,608 | B2 | 3/2006 | Flanagan | |
| 7,107,910 | B2 | 9/2006 | Hunn et al. | |
| 7,786,416 | B2 * | 8/2010 | Williams et al. | 244/3.1 |
| 8,375,860 | B2 * | 2/2013 | Bittle et al. | 102/501 |
| 2010/0057285 | A1 * | 3/2010 | Murphy et al. | 701/23 |
| 2011/0272518 | A1 * | 11/2011 | Bittle et al. | 244/3.1 |
| 2012/0279413 | A1 * | 11/2012 | Bittle et al. | 102/517 |

OTHER PUBLICATIONS

Advertisement: "S-Shaped Green Chair" having stackable design, available on internet at least by Apr. 5, 2010, http://www.overstock.com/Home-Garden/S-shaped-Green-Chair-Set-of-2/3063508/product.html.

Advertisement: "Rocket shape promotion ballpoint pen", Available on internet at least by Apr. 5, 2010, http://www.alibaba.com/showroom/rocket-pen.html.

Peak of Flight Newsletter, Issue 220, Oct. 21, 2008, "Can you Design a 2-Fin Rocket?" Cover page and pp. 7-8.

* cited by examiner

TWO-FIN STACKABLE FLECHETTE HAVING TWO-PIECE CONSTRUCTION

This is a continuation-in-part of U.S. Pat. No. 8,375,860 filed on May 4, 2011 and which is incorporated by reference herein.

DEDICATORY CLAUSE

The invention described herein may be manufactured, used and licensed by or for the U.S. Government for U.S. Government purposes without payment of any royalties thereon.

BACKGROUND OF THE INVENTION

1. Field of the Invention

The present invention pertains to flechettes or dart-like projectiles.

2. Discussion of the Background

Conventional flechettes in the 60 grain to 150 grain weight class have been used successfully in weapons but suffer from two drawbacks. The first drawback is that their flight characteristics are suboptimal. High speed film of their flight shows that most of the flechettes dispensed from a warhead pitch and yaw significantly during their flight.

It is understood that the pitch and yaw behavior, which slows the flechettes and reduces their lethality, is due to a combination of transverse angular rates induced at dispense, aerodynamic or physical interactions between flechettes in the dispensed population, and manufacturing imperfections in the flechettes themselves.

As a result of these effects, flechette patterns are typically extremely elongated along the axis tangent to the flight path, with a significant time lag between the arrival at the target of the first flechettes, (which have the highest velocity and are the most lethal), and the last arriving, slower flechettes (which are the least lethal). The elongated patterns indicate that conventional flechettes lose significant portions of their velocity and lethality attempting to recover a nose-first orientation after experiencing high transverse angular rate perturbations.

The second drawback with the conventional flechette design is that packing constraints limit the size of the flechette tailfins to a size smaller than would be ideal to optimize their flight stability. (Flechettes having four tailfins are the conventional design). If the tailfins are made larger for better flight performance, the flechettes do not pack well. If they are made smaller for better packaging, the flechettes lose even more terminal performance due to increased angular rate oscillations.

SUMMARY OF THE INVENTION

The flechette of the present invention has its concentration of mass centered in a forward section for stability with a center of pressure being located proximate to the root of the tail. In the tail section of the flechette, two tailfins are arranged in a flattened out "Z" or S-shaped formation when viewed from the aft end of the flechette. The flechette of the present invention is designed to allow for effective stacking while maintaining effective flight performance.

The flechette body is rectangular with an aspect ratio chosen so that the packing density is maximized, and the tailfins are rotated to an angle relative to the rectangular flechette body so that the tailfins of adjacent flechettes do not interfere with each other. Additionally, the tailfins of the flechette are angled to improve flight characteristics by inducing a spin to the flechette as it flies through the air. The wide separation between the center of gravity of the flechette and its center of pressure ensures that the flechette recovers quickly from any pitch or yaw angle (up to being completely reversed). Inducing a rolling moment to the flechette allows the perturbations caused by manufacturing imperfections to be integrated out of the flight path while the flechette is in flight.

The flechette of the present invention experiences low drag while achieving uniform and stable flight characteristics. When multiple flechettes of the present invention are stacked into a packaged unit, each flechette of the packaged unit, upon being dispensed, will achieve similar flight characteristics so as to arrive at a target with greater uniformity and accuracy.

The flechette of the present invention is made by a two-part construction, with a two-fin spinning airframe and is manufactured by sheet metal or equivalent by folding and bending operations.

When multiple flechettes are stacked, the forebodies of the flechettes stack in parallel and in contact, in rows and columns. The parallel stacking is both on the top and bottom surfaces and on the sides. The canted two tailfins nest without interference when stacked in rows and columns. The flechette has a generally rectangular forebody, with curved sides, that is self clocking for stacking purposes.

DESCRIPTION OF THE DRAWINGS

A more complete appreciation of the invention and many of the attendant advantages thereof will be readily obtained by reference to the following detailed description when considered in connection with the accompanying drawings.

DETAILED DESCRIPTION

Figure 1:
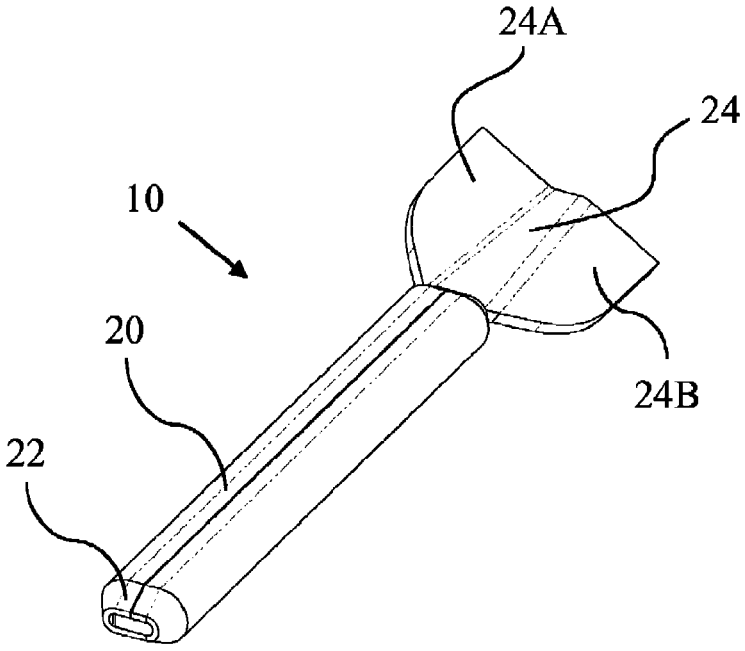
FIG. 1 is a perspective drawing of the flechette of the present invention.

With reference to FIG. 1, the flechette 10 of the present invention has a forward body 20 which has a substantially rectangular box-like shape, with the forward body 20 having a front tip or nose 22. The forward body 20 is connected to a tail section 24 with the tail section 24 having two integrally connected tailfins or fins 24A, 24B located at the aft of the flechette 10. Both fins 24A, 24B are arranged so as to form a compound angularity which is represented by a longitudinal angle θ and a radial angle Φ (FIGS. 2 and 3).

Figure 2:
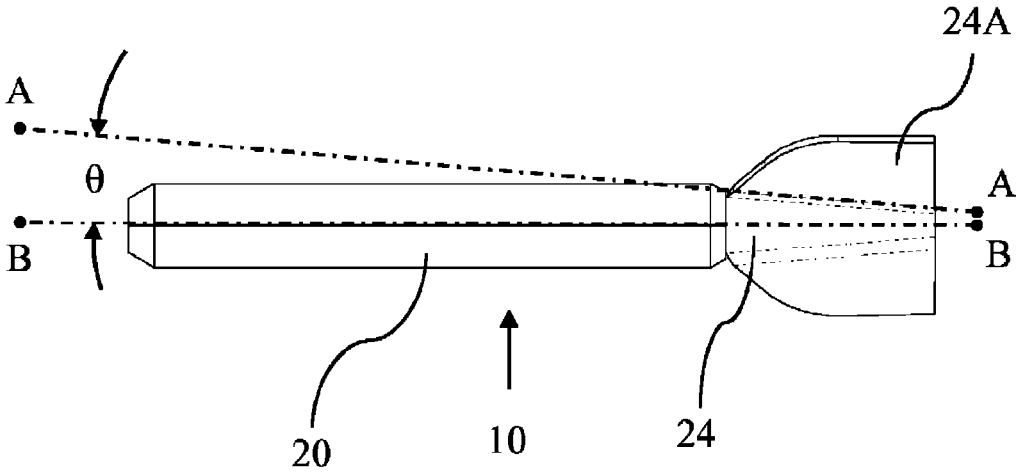
FIG. 2 is a top or bottom view of the flechette of the present invention.

In FIG. 2, angle θ is understood as being that angle formed by dotted lines AA and BB. Line AA represents the bend axis where the tailfin 24A adjoins the flat portion of the tail section 24 and line BB represents the longitudinal center line of the flechette 10. In a flight-tested prototype of the present invention, the angle θ measured 4.5 degrees.

Figure 3:
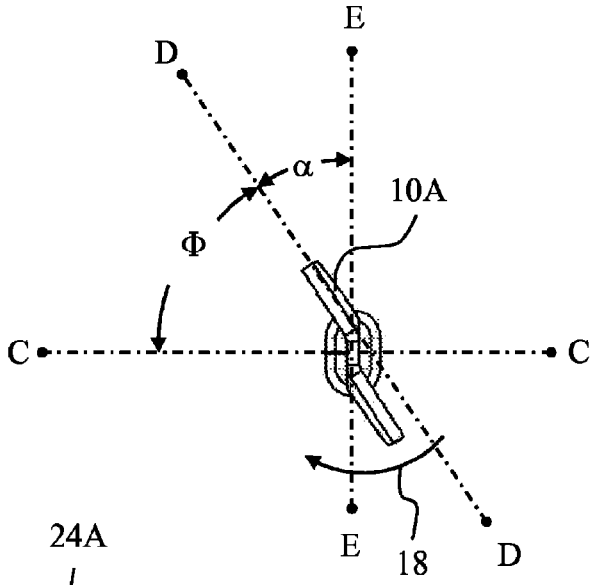
FIG. 3 is an aft view of the two tailfins of the present invention which demonstrates a relatively flat, generally "Z" or S-shaped arrangement of the tailfins.

With reference to FIG. 3, a radial angle Φ is formed by axis line CC and line DD. Line DD is colinear with the underside edge of fin 24A. Line EE is normal to line CC. Lines DD and EE form angle α. As FIG. 3 further demonstrates, fins 24A and 24B have a Z-shaped or S-shaped orientation. As is portrayed by arrow 18 of FIG. 3, the shape and angular orientation of fins 24A and 24B cause flechette 10 to spin or rotate in flight.

In a successfully tested prototype of the present invention, the angle θ measured 4.5 degrees, the radial angle Φ measured 57 degrees and angle α formed by lines EE and DD measured 33 degrees. Also, in the successfully tested prototype of the present invention, the total length of the flechette measured approximately two inches long. The tail section was approximately 0.5 inches long, with the forward body being about 1.5 inches long. The forward body was approximately 0.2 inches wide and 0.1 inches thick. The width of the tail section at its widest point was approximately 0.4 inches. The teachings of the present invention can be utilized in a flechette of other dimensions and angularities; thus the given dimensions of the successfully tested prototype are in no way to be considered limiting as to the invention claimed.

Figure 13:
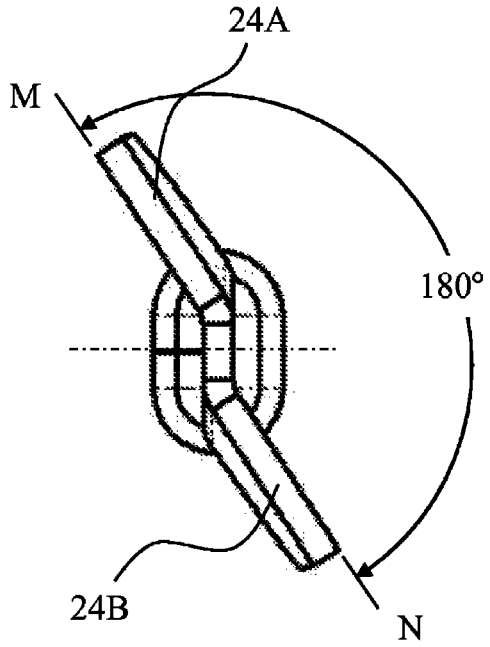
FIG. 13 is an aft view of the two tail fins of the flechette of the present invention demonstrating that the end aft radial edges or points on the undersides of the two tail fins are approximately 180 degrees apart.

To further appreciate the angular relationship of tailfins 24A and 24B, in the successfully tested prototype of the present invention an extreme aft point M located on the topside of tail fin 24A and an extreme aft point N located on the underside of tail fin 24B were located approximately 180 degrees apart (see FIG. 13). As such, in the prototype tested, the extreme aft point M and extreme aft point N could be thought as being in a substantially half-circle orientation to one another.

Figure 4:
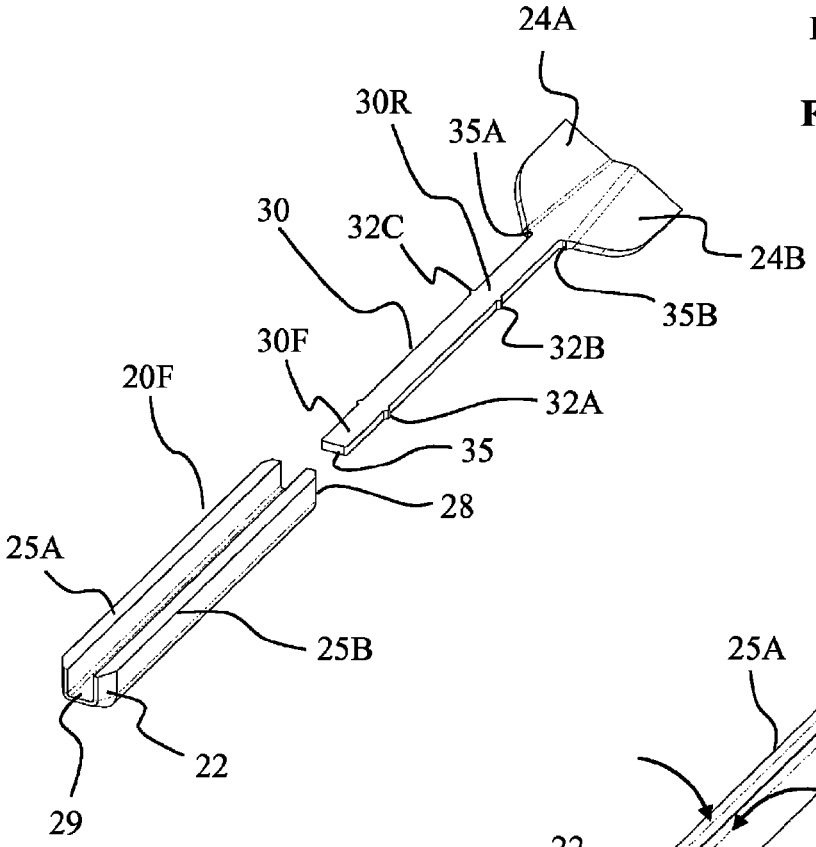
FIG. 4 is an exploded view of the tip and quill of the present invention prior to assembly.

In FIG. 4, a flechette 10 of the present invention includes forward section 20F having sides 25A, 25B which define and are integrally connected to a bottom or trough 29 of the forward section 20F. A quill section 30, is integrally connected to tail section 24, and extends from tip 35 to the roots 35A, 35B of tail section 24.

Quill section 30 slides into the trough 29 of the forward section 29F until the front tip 35 of the quill section 30 is located at the nose 22 of the forward section 20F. Serrated barbs, such as barbs 32A, 32B, 32C are positioned on the sides of the quill section 30 so as to secure contact with the sides 25A, 25B of forward section 20F upon assembly.

Upon insertion into the trough 29 of the front section 20F, the tip 35 of quill section comes to rest at the nose 22 of the forward section 29F. When press-fit and stamped during the assembly process, the quill section 30 and the front section 20F become forward body 20.

The flechette 10 of the present invention can be made of carbon steel sheet or strip or virtually any appropriate material. It is not required that the quill section 30 and the front section 20F be made from the same material.

Figure 5:
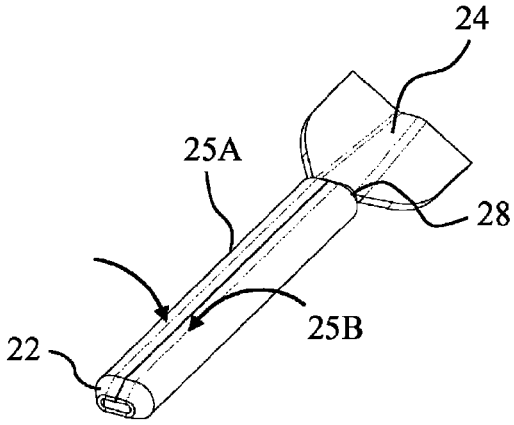
FIG. 5 is frontal perspective view of an assembled flechette of the present invention.

The nose of the flechette is tapered as is the rear 28 of the forward body 20. This tapering can be done before or after the assembly process. The nose 22 can be further machined to give a desired shape, such as a sharp or pointed nose, but the tapered nose shown in FIGS. 2 and 5 has performed well in tests.

Once the flechette 10 of the present invention is manufactured and assembled, the flechette becomes a one-piece aerodynamic body of symmetrical shape. (Thus, the terms top or bottom can be used interchangeably in respect to flechette 10). The quill section 30 can be cut from steel or aluminum sheet or strips with a material composition and thickness suitable to common sheet metal for manufacturing and forming processes. The front section 20F can be made from similar or higher density materials to that of quill section 30 and can be formed from metal tubing, metal sheet, strip material or other suitable material.

Figure 6:
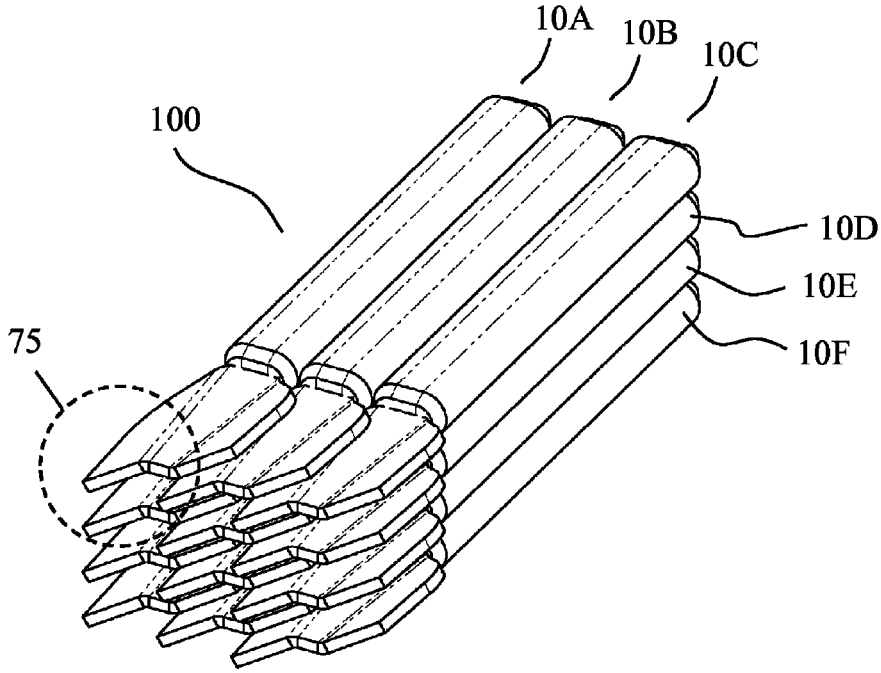
FIG. 6 is a perspective view of packaged flechettes of the present invention which are stacked in rows and columns.

FIG. 6 demonstrates the stacking capability of the flechette of the present invention, where a stacked rectangular array of flechettes 100 according to the present invention has three columns and four rows of flechettes with flechettes 10A, 10B and 10C forming one row of flechettes and flechettes 10C, 10D, 10E and 10F form one column of flechettes. Dotted circle 75 highlights how the "Z" or S-shaped fins of the flechettes of the present invention allow effective stacking without detrimental interference between the flechettes.

Figure 7:
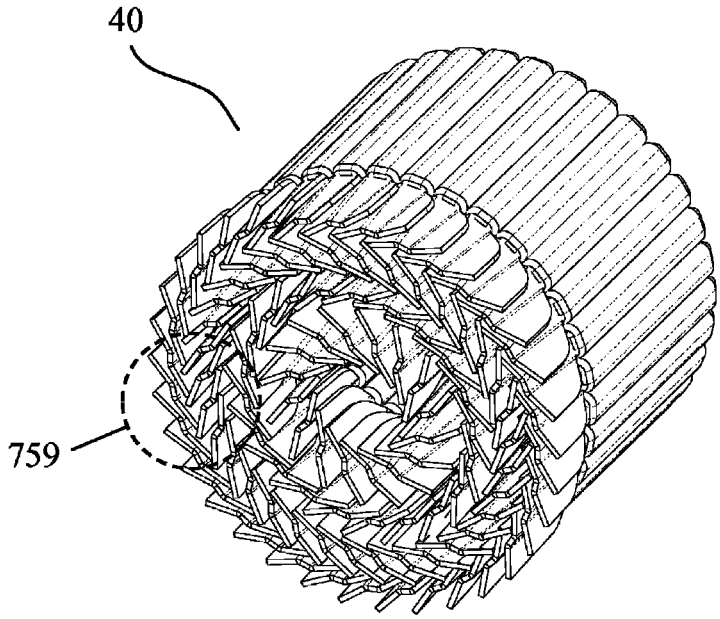
FIG. 7 is a perspective view of packaged flechettes of the present invention which are stacked in a radial arrangement.

In FIG. 7, a radially stacked arrangement or puck 40 of flechettes according to the present invention is shown which demonstrates four radially oriented rows or circles of flechettes. Dotted circle 759 highlights that the "Z" or S-shaped fins of the flechette 10 of the present invention allow multiple flechettes of the present invention to be radially packaged without interference between adjacent flechettes within the same radially row and without interference between the flechettes in adjacent radial rows.

Figure 8:
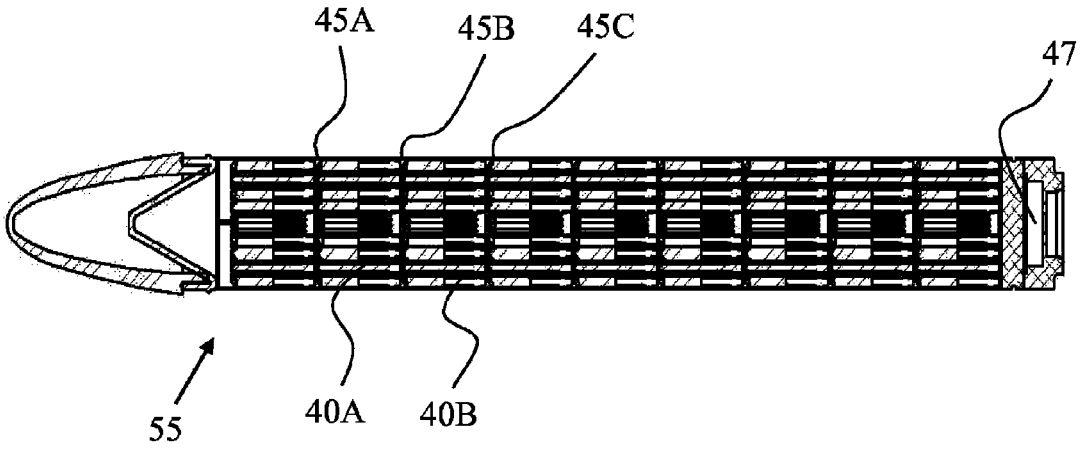
FIG. 8 is a side, sectional view of a warhead in which flechettes of the present invention are stacked into discrete packages or pucks without interleaving.

In FIG. 8, a warhead 55, such as, for example, the warhead of a Hydra 70 rocket, is provided with a hollow cylindrical casing in which discrete pucks of flechettes are stacked unlike the prior art where the flechettes are longitudinally interleaved to achieve the necessary packing density. Pucks 40A, 40B, etc., of flechettes according to the present invention are stacked within the casing in the orientation demonstrated in FIG. 7.

The discrete packaging arrangement is shown as the areas 45A, 45B, 45C, etc., where the tails of the flechettes in the preceding puck are in contact with the nose of the flechettes in the subsequent puck. A pusher charge 47 burns to shear the warhead nose off thereby expelling the flechettes out of the front of the casing.

Figure 9:
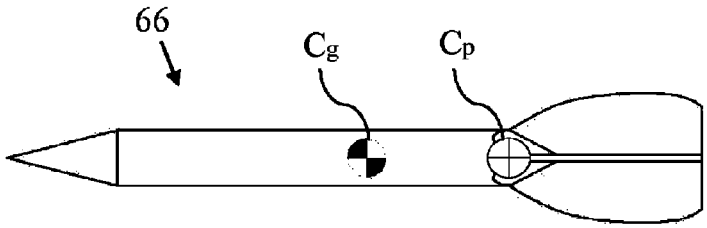
FIG. 9 (Prior Art)
FIG. 9 is a side view of a typical prior art flechette which illustrates the location of its center of gravity relative to its center of pressure.

In FIG. 9, the center of gravity $C_g$ and the center of pressure $C_p$ of a typical, conventional, prior art flechette 66 is shown.

Figure 10:
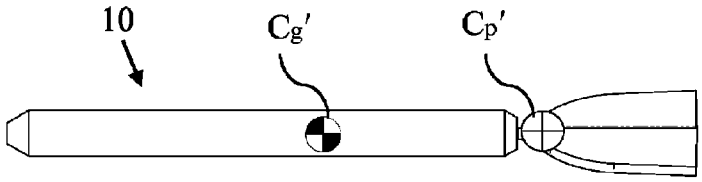
FIG. 10 is a side view of a flechette according to the present invention which illustrates the location of its center of gravity relative to its center of pressure.

In FIG. 10, a side view of the flechette 10 according to the present invention demonstrates the location of the center of gravity Cg' and the center of pressure Cp' on the flechette of the present invention. One will notice that the center of gravity is further forward and the center of pressure is further backward than in the typical prior art flechette which indicates greater aerodynamic stability.

Figure 11:
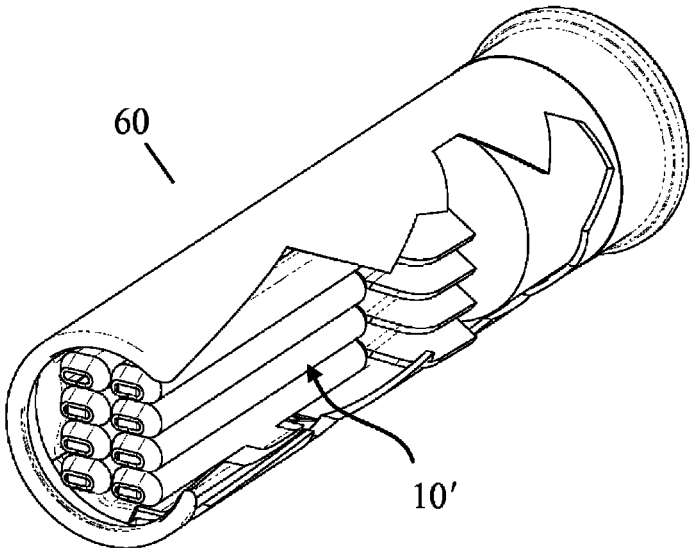
FIG. 11 is a cut-away, perspective view of stacked flechettes according to the present invention stacked within a shotgun shell.

In FIG. 11, a shotgun shell 60 according to the present invention has a stacked configuration of flechettes 109 arranged within the shell. As an alternative to the arrangement of FIG. 12, the flechettes of the present invention could be arranged in a radial orientation so as to be radially stacked within the shotgun shell's wadding.

Figure 12:
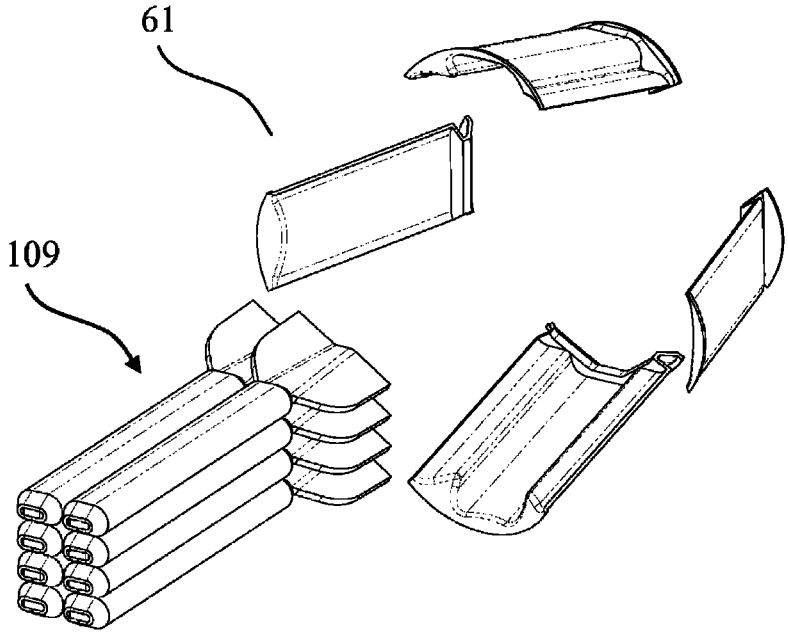
FIG. 12 is a perspective view illustrating flechettes of the present invention as they would appear exiting the barrel after having been fired from a shotgun.

FIG. 12 shows a stacked configuration of flechettes 109 as they would appear after being fired from a shotgun as the conformal plastic sabots 61 housing the flechettes in the shotgun shell are aerodynamically discarded upon exiting the gun's barrel.

Figure 14:
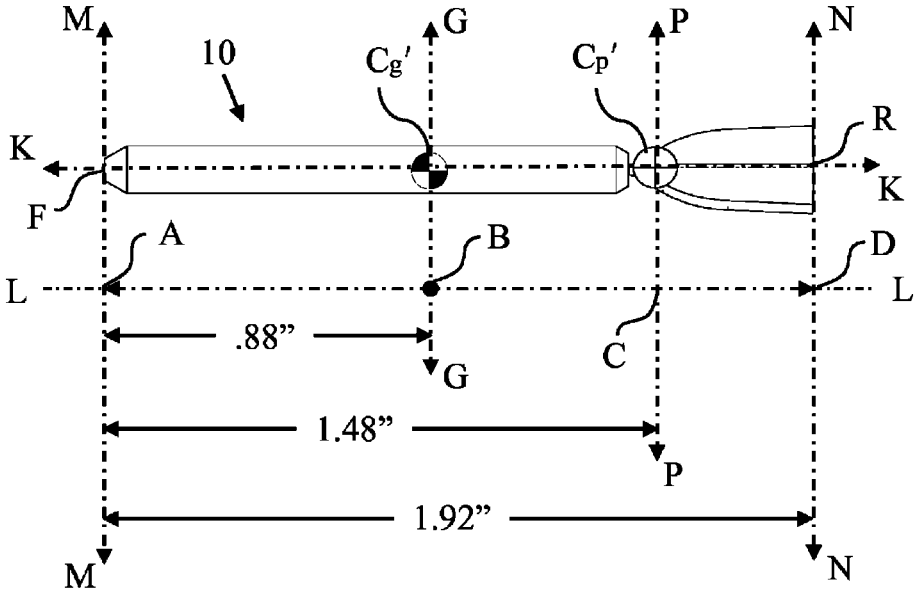
FIG. 14 is a side-view of the flechette of the present invention with axis provided for relational location appreciation of the various points and parts of the flechette.

With reference to FIG. 14, the flechette 10 of the present invention has a most forward point F and a most rear point R. The line KK is the horizontal axis of flechette 10 and extends through the center of gravity Cg' of flechette 10. Line GG extends through the center of gravity Cg' with line GG intersecting and being normal to line KK. Line PP extends through the center of pressure Cp' with line PP intersecting and being normal to line KK. Line MM extends through the most forward point F and line NN extends through most rear point R. Lines MM, GG, PP and NN are parallel to each other. Line LL is parallel to line KK. The distance from point A to point B on line LL is equal to the distance between the most forward point F and the center of gravity Cg'. The distance from point A to point C on line LL is equal to the distance between the most forward point F and the center of pressure Cp'. The distance from point F to point R is equal to the distance between point A and point D on line LL.

Still with reference to FIG. 14, in the present invention, the center of gravity is designed to be closer to point F than to point R, i.e., the center of gravity is located in the front portion of the flechette at a location which is less than half the length of the flechette as measured from point F. In other words line segment AB divided by line segment AD is less than 50%. In a protoype of the present invention, AB/AD was equal to 45.8%. Ideally the center of gravity Cg' should be as close to the front of the flechette, i.e., as close to forward point F as possible.

The radial distance of line LL from the horizontal axis KK is a further radial distance than from the horizontal axis than is the radial distance from the horizontal axis to any point on the flechette. Line LL is normal to line NN and Line LL is normal to line MM. Accordingly in that line MM intersects line LL at point A and line NN intersects point D on line LL, the distance from line segment AD on line LL is equal to the distance between the most forward point F and most rear point R.

The pragmatic features of the present invention include the fact that when the pucks 40 of flechettes are stacked within a warhead such stacking can be done without the increased cost and complexity and without the longitudinal interleaving of flechettes which occurs in the prior art. Further, the flechettes of the present invention remove the need to turn the flechettes to a particular clocking angle (to improve packing density) as is done in the prior art.

The rectangular cross section of the flechettes (see, FIG. 13) of the present invention ensures the flechettes have consistent clocking orientations and that the radial angle of the fins 24A, 24B is oriented at an angle that allows adjacent fins to nest without interference.

The transition from dispense to stable flight is a critical event in the flight of a flechette. When a shotgun shell containing the flechettes according to the present invention is fired or when the flechettes of the present invention are dispensed from a warhead, the flechettes are ejected with high translational velocity, moderate roll rate and moderate to high transverse angular pitch and yaw rates and attitudes into the air.

The location of the center of gravity of the flechette 10 of the present invention when combined with the relatively large tailfin region and its angled "Z" or S-shaped oriented, rotation-inducing fins 24A, 24B ensure optimal performance. Upon dispense, the flechettes of the present invention quickly weathervane into a nose-first flight orientation even when the fins are aerodynamically stalled due to high angles of attack.

As the flechettes of the present invention assume a nose-first orientation they begin to spin around the longitudinal axis as demonstrated by arrow 18 in FIG. 3. This spinning is accomplished by the offset separation and small incidence angle θ (FIG. 2) of the fins 24A, 24B (FIG. 4). The spinning serves the purpose of further enhancing the aerodynamic stability of the flechettes and mitigating the negative effects of high volume production tolerances and misalignments on their flight path.

As a result of the improved aerodynamic properties of the flechette of the present invention, the dispensed flechettes are able to arrive at a target area with greater accuracy and at higher and more consistent velocity. Thus, the size and number of gaps in the dispersion pattern of the flechettes is reduced and target effects are improved.

The flechette of the present invention combines simple and inexpensive manufacturing techniques with improvements in flight performance and packaging. The result is that manufacturing costs of the present invention are competitive with prior art designs; however, the effectiveness of the flechettes is much improved compared to the prior art.

Since the flechettes of the present invention are designed to be self-correcting and self-orienting, an acceptable packing density can be achieved in a warhead or shotgun shell without undue effort and expense.

After the flechettes of the present invention are released from their packaging, their forward placed center of gravity and fin dimensions and orientations ensure that the flechettes are quickly directed toward their intended flight path.

For flechettes which are dispensed from a shotgun shell, the velocity improvements translate into increased range while increasing accuracy.

The flechettes of the present invention allow for rectangular stacking with virtually any number of desired rows or columns of flechettes and allow for radial stacking with virtually any number of radial rows.

Various modifications are possible without deviating from the spirit of the present invention. Accordingly the scope of the invention is limited only by the claim language which follows hereafter.

What is claimed is:

1. A flechette comprising:

a forward body containing a center of gravity of said flechette;

a tail section directly connecting with said forward body, said tail section having a pair of fins each having a longitudinal angle and a radial angle such that when said pair of fins are viewed from the aft of said flechette, said pair of fins demonstrate an S-shaped orientation, said pair of fins providing stackability and aerodynamic stability to said flechette, and wherein said forward body being substantially rectangular in shape and having a relatively flat top surface and a relatively flat bottom surface.

2. A flechette according to claim 1, wherein:

said tail section has two fins, only, said two fins being a first fin and a second fin, said first fin and said second fin being said pair of fins.

3. A flechette according to claim 2, wherein said first fin and said second fin have an incidence angle of less than five degrees.

4. A flechette according to claim 2, wherein said first fin has a first fin extreme aft point and said second fin has a second fin extreme aft point such that the radial distance between said extreme aft points approximates a half circle.

5. A flechette according to claim 2, wherein the flechette has a most forward point and a most rear point and the center of pressure of the flechette is positioned at a location on the flechette which is more than 75% of the distance from the most forward point to the most rear point.

6. A flechette according to claim 2, wherein the center of pressure of the flechette is located in said tail section.

7. A flechette according to claim 6, wherein:

an angle formed by a bend axis of said first fin and the longitudinal center line of the flechette measures less than 5 degrees.

8. A flechette according to claim 2, wherein said first fin and said second fin are canted allowing nesting without interference when the flechette is stacked in rows and columns of like-shaped flechettes.

9. A flechette according to claim 8, wherein the distance from a most forward point of the flechette to the center of gravity of the flechette is less than half the distance than a distance from the most forward point to a most rear point of the flechette.

10. A flechette according to claim 9, wherein the center of pressure of the flechette is positioned at a location on the flechette which is more than 75% of the distance from the most forward point to the most rear point.

11. A flechette according to claim 10, wherein when the flechette is stacked with like-shaped flechettes, the front bodies of the flechette and the like-shaped flechettes stack in parallel and in contact, in rows and columns, with the parallel stacking being both on the top and bottom surfaces and sides of the flechette and like-shaped flechettes.

12. A flechette, comprising:

a forward body containing a center of gravity of said flechette;

a tail section having roots directly connecting with said forward body, said tail section having a pair of fins each having a longitudinal angle and a radial angle such that when said pair of fins are viewed from the aft of said flechette, said pair of fins demonstrate an S-shaped orientation, said pair of fins providing stackability and aerodynamic stability to said flechette, and wherein said forward body being substantially rectangular in shape and having a relatively flat top surface and a relatively flat bottom surface.

13. A flechette according to claim 12, wherein:

said flechette has a forward body having a front section surrounding a quill with said quill extending to the rear of the forward body where said quill connects with said roots of said tail section.

14. A flechette accordingly to claim 13, wherein the center of pressure of said flechette is located on in said tail section.

15. A flechette according to claim 12, wherein:

said tail section has two fins, only, said two fins being a first fin and a second fin, said first fin and said second fin being said pair of fins.

* * * * *